US005083758A

United States Patent [19]

Duke

[11] Patent Number: 5,083,758

[45] Date of Patent: Jan. 28, 1992

[54] PLUMBING TOOL

[76] Inventor: Robert L. Duke, 4154 Arden St., Clemmons, N.C. 27012

[21] Appl. No.: 480,296

[22] Filed: Feb. 15, 1990

[51] Int. Cl.[5] ..... B25B 11/00

[52] U.S. Cl. ..... 269/21; 269/68

[58] Field of Search ..... 269/21, 68; 81/129.5, 81/177.2; 29/270, 278, 281.1

[56] References Cited

U.S. PATENT DOCUMENTS 2,613,714 10/1952 Miller ..... 269/21

3,514,091 5/1970 Johnson et al. ..... 269/68

*Primary Examiner*—J. J. Hartman

[57] ABSTRACT

A plumbing tool having a suction producing effect allows for the convenient installation of plumbing components which are mounted on barriers such as within sinks which cannot be conveniently held in place by a lone individual during installation. The suction device acts as an extra "band" to allow the plumber to install and assemble components on opposite sides of sinks in a quick, safe efficient manner.

16 Claims, 4 Drawing Sheets

PLUMBING TOOL

BACKGROUND OF THE INVENTION

1. Field Of The Invention

The invention herein pertains to a suction tool for plumbers or others to be used for installing basket strainers, food disposals and other plumbing assemblies wherein a first component of the assembly is held stationary against one surface of a barrier such as an inner sink basin while a second component of the assembly is connected to the first through the opposite surface of the barrier, such as against the underneath surface of the sink.

2. Description Of The Prior Art And Objectives Of The Invention

The installation of flanged members such as sink traps, disposal ports and the like have long caused concern for plumbers and servicemen who must firmly hold components on opposite surfaces of sinks, walls or the like during installation and assembly In past years installation and service work on food disposals under kitchen sinks has generally required the use of a plumber and a helper to adequately complete the required work. The helper would hold the disposal trap flange along the inner (upper) sink surface proximate the opening in the kitchen sink while the plumber, by working underneath, would attach a pipe, food disposal or other components to the held disposal trap. However, in recent years with the cost of labor ever increasing, many plumbers now prefer, and in some cases must work alone, although many jobs need an extra "hand" from time to time to stabilize or to reach a component or part as they work through an opposite barrier surface. Oftentimes a lone plumber will install a food disposal by working mainly underneath the sink, only to realize when arising that the previously positioned topside trap flange has shifted somewhat, requiring the disposal be disconnected and reset, much to the chagrin of the installer.

Thus, with the disadvantages and problems associated with prior art tools and methods available, the present invention was conceived and one of its objectives is to provide a unique tool which will assist a plumber in working alone when installing basket strainers, food disposals or other assemblies and components that are connected through an inconvenient to reach-around barrier wall.

It is yet another objective of the present invention to provide a tool for assisting in installing various plumbing components which will temporarily maintain a component in a steady, fixed manner until fully set.

It is still another objective of the present invention to provide a tool which includes a suction cup and pressure plate for retaining a plumbing component in an immovable posture such as along the inner or top surface of a conventional kitchen sink and which can easily be removed from the component when the work is completed.

It is yet another objective of the present invention to provide a suction tool for use by plumbers or others which is relatively easy to learn to use, long lasting and which is inexpensive to purchase.

Numerous other objectives and advantages of the present invention become apparent to those skilled in the art as a more detailed description is presented below.

SUMMARY OF THE INVENTION

The aforesaid and other objectives are realized by providing a tool which produces a suction force to hold a plumbing component against a sink bottom or the like which may have various embodiments, each consisting of a rigid pressure plate or disk which is connected to a suction cup. In one embodiment a longitudinal member has suction cups at each end which securely attaches the tool to the bottom of a sink or other barrier surface. The pressure plate is affixed to the bottom end of a transverse member which is slidably received perpendicularly within the longitudinal member. By manually urging the transverse member downwardly where it is held by a pawl, the pressure plate presses against the flange of a basket strainer to temporarily hold the flange in place. A plumber can then attach pipes or other components to the strainer by working beneath the sink to permanently secure the strainer in place. Thereafter, by relieving the suction force created by the tool, the tool can be removed from the basket strainer with the strainer correctly installed.

DESCRIPTION OF THE PREFERRED EMBODIMENT

Figure 1:
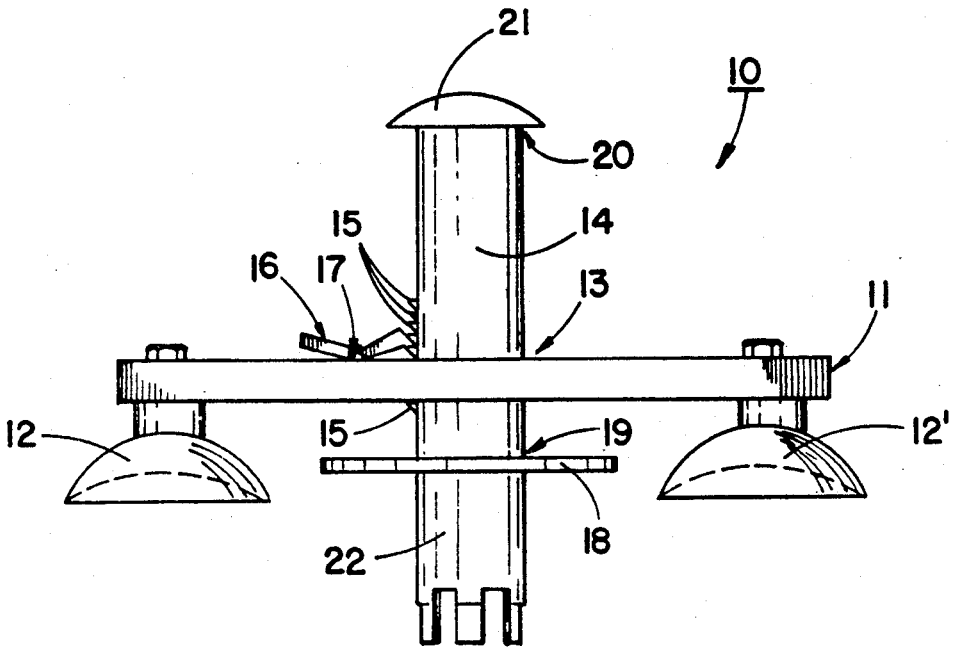
FIG. 1 illustrates a side view of the suction tool which may be used in conventional kitchen sinks for releasably, temporarily holding basket strainers or the like therein.

The preferred form of the invention is shown in FIG. 1 whereby a pair of suction cups are joined at opposite ends to a longitudinal member. The longitudinal member defines a vertical slot approximately mid-way therealong through which a transverse member is slidably positioned perpendicularly to the longitudinal member. A pressure plate in circular form is affixed at the distal end of the transverse member and a strainer insert is attached to the underneath surface of the pressure plate for retaining a conventional basket strainer. On the upper end of the transverse member is situated a knob for applying manual force to the notched transverse member and a pivotal pawl is mounted on the longitudinal member, near the slot for "locking" the transverse member in position relative to the longitudinal member for maintaining pressure on the basket strainer or the like during installation.

DETAILED DESCRIPTION OF THE DRAWINGS AND OPERATION OF THE INVENTION

Figure 2:
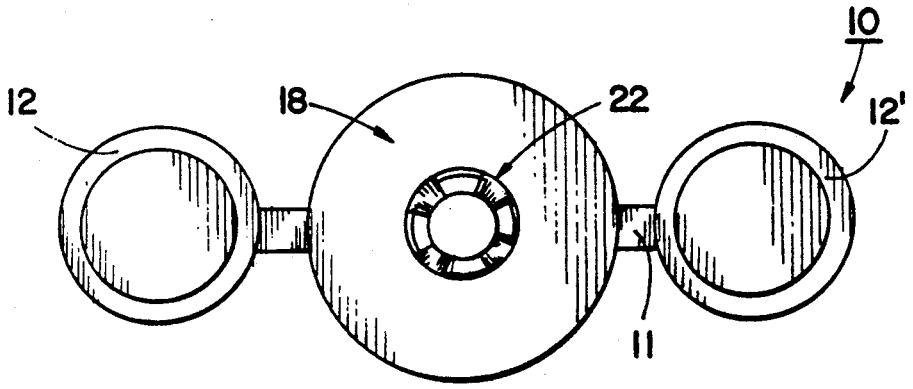
FIG. 2 shows a bottom view of the embodiment of the tool as shown in FIG. 1.
Figure 3:
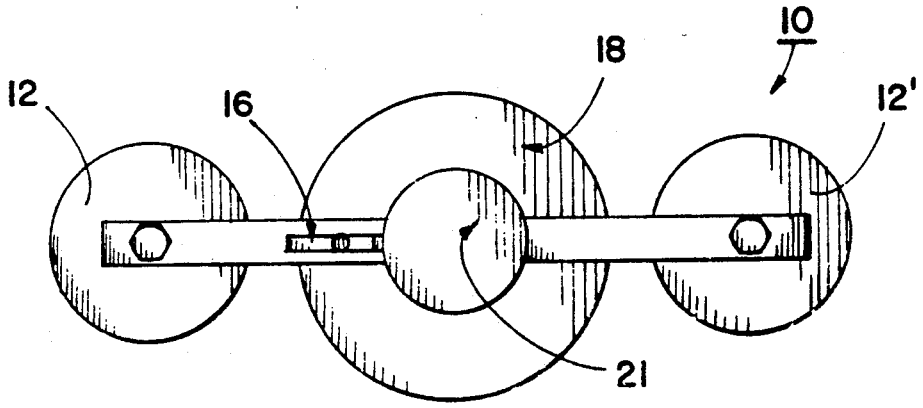
FIG. 3 demonstrates a top view of the tool as seen in FIG. 1.

For a more complete understanding of the invention and its method of use, turning now to the drawings, FIG. 1 demonstrates plumbing tool 10 which consists of longitudinal member 11 having means providing a suction in the form of suction cups 12, 12'. Longitudinal member 11 includes a slot 13 through which transverse member 14 slides. Transverse member 14 is notched and includes a series of teeth 15 along one side thereof. Pawl 16 is pivotally attached at 17 to longitudinal member 11. Pressure member 18 as seen in FIG. 1 consists of a rigid, circular metal plate which is affixed at the distal end 19 of transverse member 14. At the proximal end 20 of transverse member 14, a rounded knob 21 for applying manual pressure thereto is seen. As would be understood, pawl 16 which is spring-loaded, allows transverse member 14 to pass through longitudinal member 11 and locks member 14 into place as pawl 16 engages teeth 15 therealong. In the bottom view of tool 10 in FIG. 2, strainer insert 22 is shown. The top view of tool 10 as shown in FIG. 3 demonstrates the configuration thereof in another perspective, and as would be understood, tool 10 may have various parts formed from plastic, metal or other materials as suitably appropriate.

Figure 4:
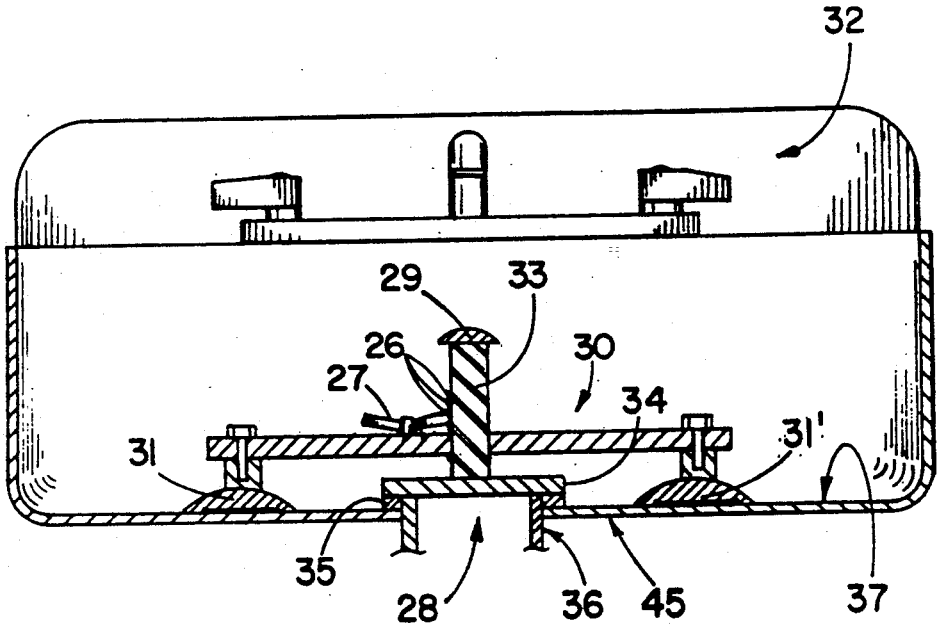
FIG. 4 pictures a cross-sectional view along the front of a conventional sink with a second embodiment of the tool as shown in FIG. 1 used to secure a food disposal trap within the sink.

In FIG. 4 plumbing tool 30 is shown which is substantially similar to plumbing tool 10 of FIG. 1 with the exception that tool 30 does not include strainer insert 22, as would be needed for basket strainer installations. FIG. 4 depicts tool 30 affixed to sink 32 by suction force generated by suction cups 31, 31' along the upper inside surface 37 of sink 32, and illustrated in cross-sectional view. Transverse member 33 is in a locked downwardly position whereby pressure member 34 applies pressure to food disposal trap flange 35.

Figure 5:
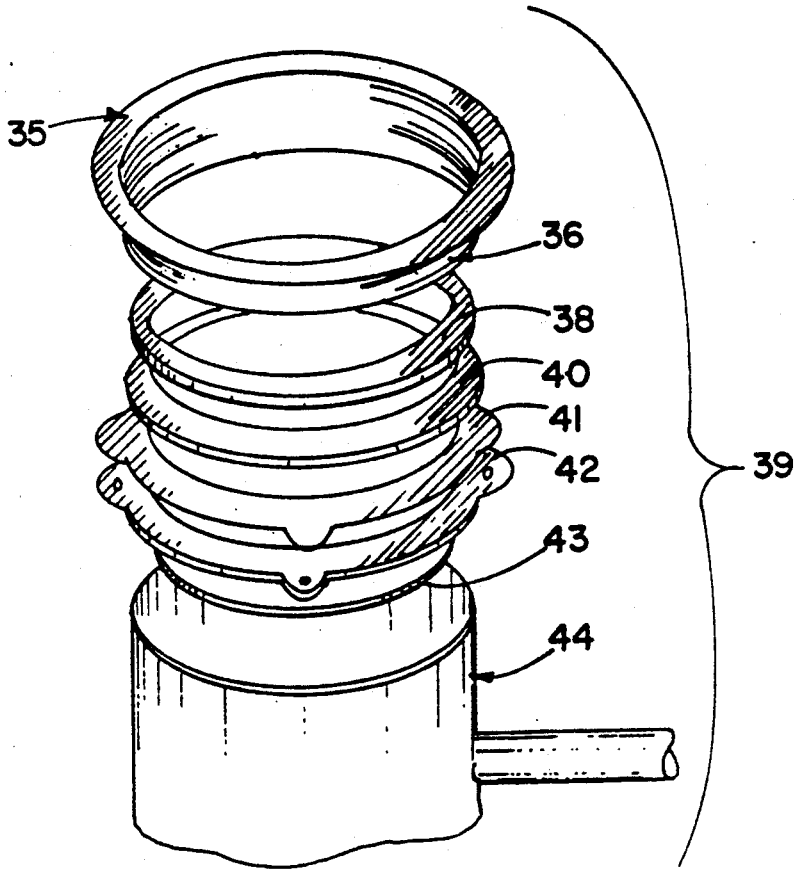
FIG. 5 depicts in exploded fashion the assembly components of a conventional food disposal in which the disposal trap is installed from above the sink whereas the remaining components are installed beneath the sink.

As further seen in FIG. 5, food disposal 39 consists of a series of assembly components including food disposal trap 36 having flange 35 thereon. As would also be noted, food disposal trap 36 is positioned along the inner surface 37 (FIG. 4) of sink 32. Other assembly components as seen in FIG. 5 include rubber gasket 38, fiber gasket 40, metal flanged member 41, threaded member 42, snap ring 43, and power unit 44 which are all assembled beneath sink 32, against bottom sink surface 45 (FIG. 4).

Figure 6:
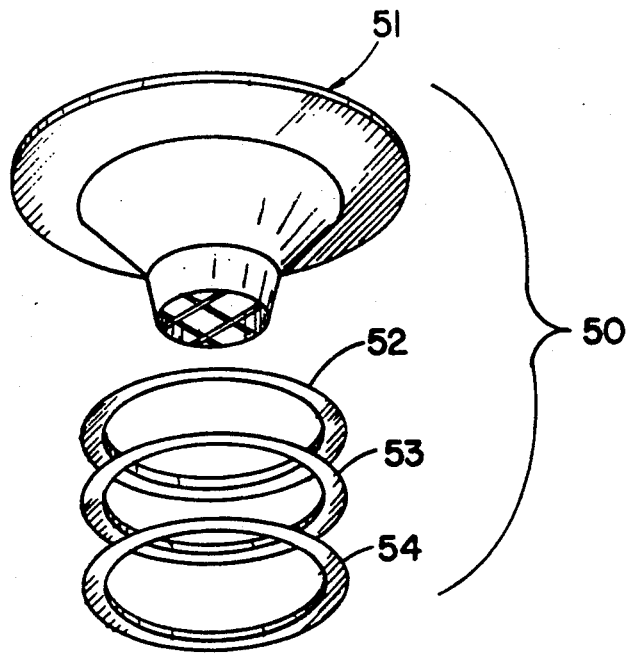
FIG. 6 illustrates a conventional basket strainer having certain components installed above and other components which are installed below the sink.

Another series of assembly components are depicted in FIG. 6 whereby basket strainer assembly 50 is shown with basket strainer 51 placed along the top or upper surface of a sink. As further illustrated in exploded fashion in FIG. 6, basket strainer 51 is held in place by rubber gasket 52, fiber gasket 53 and metal lock ring 54 which are attached to basket strainer 51 from beneath the sink.

Figure 7:
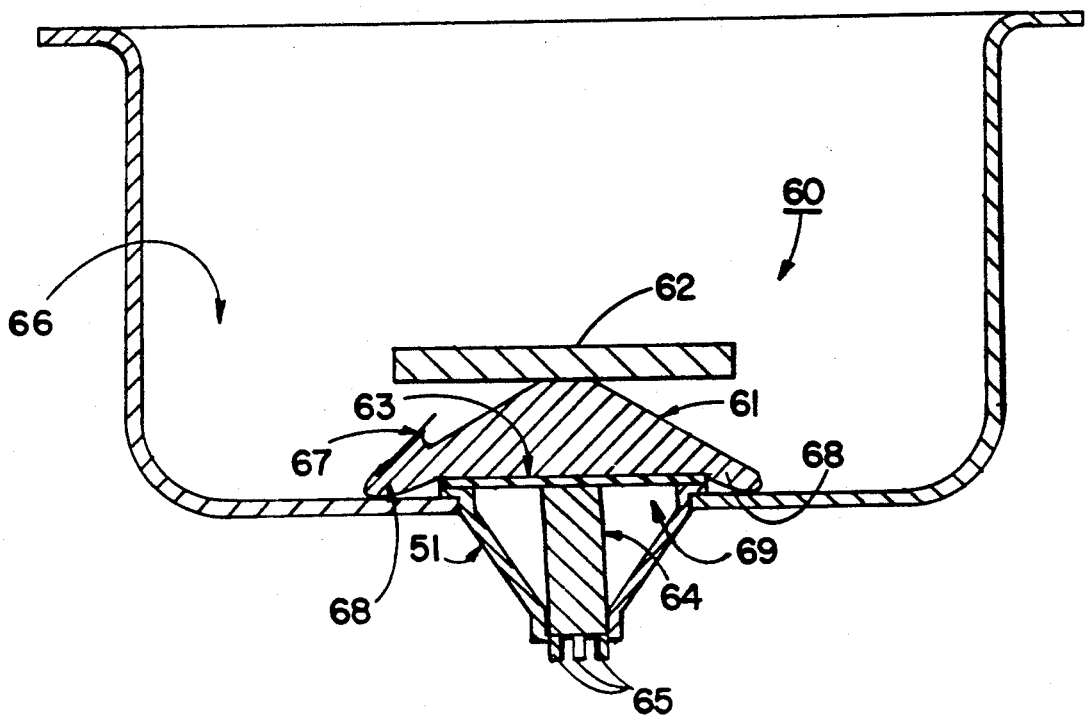
FIG. 7 demonstrates yet another embodiment of the tool in which a suction cup is provided with a central pressure plate having a strainer insert joined thereto as seen in side cross-sectional view.

As pictured in cross-sectional view, tool 60 in FIG. 7, comprises a single means for developing suction by use of suction cup 61 attached at its uppermost end to handle 62. Suction cup 61 is formed from conventional polymeric materials and utilizes pressure plate 63 which is centrally positioned thereunder as presented in FIG. 8. Strainer insert 64 provides a series of teeth 65 to maintain basket strainer 51 in firm engagement within sink 66 as shown in FIG. 7. Suction cup release lever 67 also is shown in FIG. 7 which is affixed to the side of suction cup 61. Release lever 67 is employed when it is desirable to remove plumbing tool 60 by pressing downwardly therealong whereby lip 68 will be lifted and the suction force dissipated so tool 60 can be easily removed therefrom.

In use, after disposal trap 36 is conventionally placed in sink opening 28 as seen in FIG. 4, tool 30 is pressed downwardly against inner surface 37 of sink 32 with transverse member 33 in its upper most position. Suction cups 31, 31' will firmly grip surface 37. Manual force can then be applied to knob 29 causing pressure member or plate 34 to contact flange 35 of trap 36, and flange 35 is forced against surface 37. Pawl 27 which is spring-loaded engages teeth 26 on transverse member 33 to "lock" member 33 in its downward posture. Once installation of the disposal is completed from beneath sink 32, suction cups 31, 31' are lifted and tool 30 is easily removed.

Figure 8:
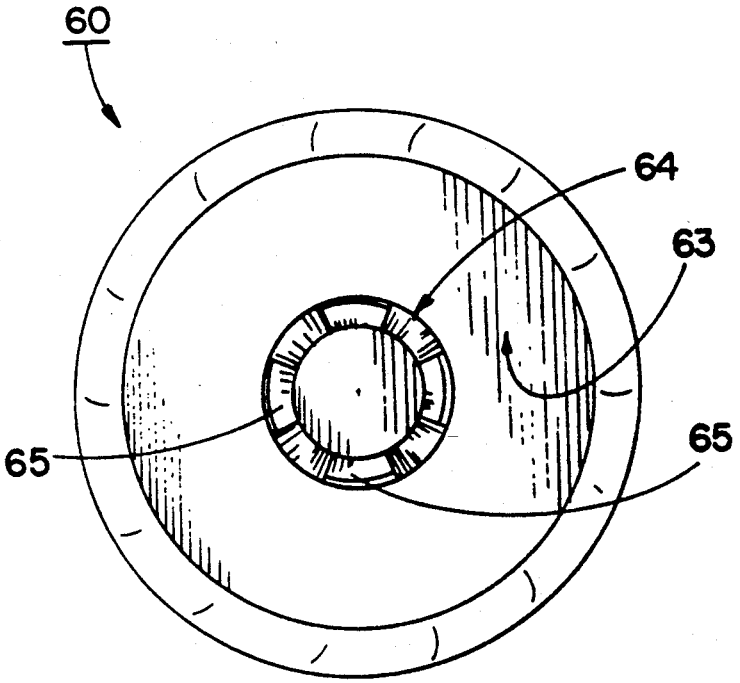
FIG. 8 demonstrates the tool of FIG. 7 shown in a bottom plan view.

The embodiment of tool 60 as seen in FIGS. 7 and 8 is likewise easily employed, but tool 60 has only a one step attachment method. Tool 60 is positioned over basket strainer 51 and is pressed downwardly whereby pressure plate 63 urges strainer 51 tightly into sink opening 69 and basket insert teeth 65 prevent strainer 51 from rotating. A suction force is achieved by suction cup 61. To release cup 61, lip 68 is lifted by applying finger pressure to release lever 67 mounted on the side of cup 61. Handle 62 allows for convenience in removing tool 60 from sink 66 which may have small inside dimensions and could not accommodate wider tool 10 as seen in FIG. 1.

The illustrations and examples provided herein are for explanatory purposes and are not intended to limit the scope of the appended claims.

I claim:

1. A tool for assembling and installing plumbing components comprising: means for manually developing a suction by pressing a suction means against a surface, said suction means comprising a pair of suction cups; a longitudinal member, said suction cups joined to said longitudinal member; a pressure member for contacting a plumbing component, said pressure connected to and longitudinal member in a transverse manner said suction means cooperation with said pressure member whereby said suction cups will hold said pressure member against said plumbing component during installation of said plumbing component.

2. A tool as claimed in claim 1 wherein said suction cups are formed from a synthetic polymer.

3. A tool as claimed in claim 1 wherein said suction means encloses said pressure member.

4. A tool as claimed in claim 1 wherein said suction means has a diameter greater than said pressure member.

5. A tool as claimed in claim 1 and including means to relieve suction, said suction relief means affixed to said suction means.

6. A tool as claimed in claim 1 and including a notched strainer insert, said insert jointed to said pressure member.

7. A tool as claimed in claim 1 wherein said pressure member comprises a rigid circular member.

8. A tool as claimed in claim 1 wherein said suction cups are affixed at each end of said longitudinal member, a transverse support, said support slidably joined to said longitudinal member, and said pressure member joined to said transverse support.

9. A tool as claimed in claim 8 wherein said transverse support is notched.

10. A tool as claimed in claim 9 and including a pawl, said pawl attached to said longitudinal member, said pawl for engaging said notched transverse support.

11. A tool as claimed in claim 8 wherein said pressure member is attached to one end of said transverse support, a knob, said knob attached to the opposite end of said transverse support.

12. A tool for assembling plumbing components in a sink-like structure comprising: means to manually produce a suction, said suction means comprising a pair of suction cups, a longitudinal member, said suction cups affixed at each end of said longitudinal member, said longitudinal member defining an opening therein, a transverse support, said support slidably mounted in said opening, means to lock said transverse support relative to said longitudinal member, a pressure member, said pressure member attached to said transverse support below said longitudinal member between said pair of suction cups whereby said suction cups can be attached to a sink and said pressure member positioned against a plumbing component to releasably hold the component in a desired position during a plumbing assembly.

13. A tool as claimed in claim 12 and including a knob, said knob affixed to said transverse member.

14. A tool as claimed in claim 13 wherein said knob is attached to one end of said transverse member, and said pressure member is attached to the opposite end thereof.

15. A tool as claimed in claim 12 wherein said transverse member is notched.

16. A tool as claimed in claim 15 wherein said lock means comprises a pawl, said pawl pivotally attached to said longitudinal member, said pawl for engaging said notched transverse member to releasably lock said transverse member to said longitudinal member to prevent vertical movement of said transverse member.

* * * * *